US009808946B2

(12) United States Patent
Clarke

(10) Patent No.: US 9,808,946 B2
(45) Date of Patent: Nov. 7, 2017

(54) APPARATUS FOR SPLITTING WOOD INTO KINDLING

(71) Applicant: Dana Stone Clarke, Santa Cruz, CA (US)

(72) Inventor: Dana Stone Clarke, Santa Cruz, CA (US)

( * ) Notice: Subject to any disclaimer, the term of this patent is extended or adjusted under 35 U.S.C. 154(b) by 1193 days.

(21) Appl. No.: 13/843,064

(22) Filed: Mar. 15, 2013

(65) Prior Publication Data

US 2014/0261892 A1 Sep. 18, 2014
US 2016/0339601 A9 Nov. 24, 2016

Related U.S. Application Data

(63) Continuation-in-part of application No. 12/507,021, filed on Jul. 21, 2009, now Pat. No. 8,424,212.

(51) Int. Cl.

*B26B 23/00* (2006.01)
*B27L 7/00* (2006.01)
*B27L 7/08* (2006.01)

(52) U.S. Cl.

CPC ..... *B26B 23/00* (2013.01); *B27L 7/005* (2013.01); *B27L 7/08* (2013.01)

(58) Field of Classification Search

CPC ..... B26B 23/00; B25D 1/00; B27L 7/005
USPC ..... 30/308.1, 167–167.2, 171, 172, 164.5, 30/164.8, 142, 299, 302; 81/20; 403/230, 247, 248; D8/7, 10, 11, 47, D8/76–81; 7/145, 104, 114, 116, 122, 7/158, 159; 172/371, 374, 375, 377, 381, 172/382; 125/40–43

See application file for complete search history.

(56) References Cited

U.S. PATENT DOCUMENTS 111,024 A * 1/1871 White ..... B26B 3/00 30/308.1
153,164 A 7/1874 Morrison
176,807 A * 5/1876 Potter ..... F16B 12/2009 30/308.1
292,964 A 1/1884 Fuchs
378,650 A * 2/1888 Bigelow ..... B25D 1/00 81/20

(Continued)

FOREIGN PATENT DOCUMENTS

AT 185266 4/1956
DE 4035679 9/1990

(Continued)

*Primary Examiner* — Jason Daniel Prone
(74) *Attorney, Agent, or Firm* — Birdwell & Janke, LLP

(57) ABSTRACT

A specialized wood splitting tool and chopping block, used together, enable cutting kindling from ordinary firewood in an effective and safe manner. The splitting tool uses leverage in addition to downward momentum of the cutting head to split wood. The metal handle and metal cutting head are preferably formed from a single piece of steel, in a perpendicular configuration similar to an adz. A splitting wedge blade within the handle exerts transverse shear forces to enhance splitting, and flat upper surfaces of the cutting head and the handle near the joint provide a striking surface. A complimentary chopping block for bracing logs of various diameters in a steady upright position has a V-shaped recess that is open on one end. The chopping block provides resistance to the unique leverage of the splitting tool during the splitting action.

16 Claims, 4 Drawing Sheets

(56) References Cited

U.S. PATENT DOCUMENTS

| | | | | | |
|---|---|---|---|---|---|
| 720,010 | A | | 2/1903 | Eiden | |
| 732,036 | A | | 6/1903 | Best | |
| 776,734 | A | | 12/1904 | Puller | |
| 838,405 | A | | 12/1906 | Henkel | |
| 934,008 | A | * | 9/1909 | Olson | B26B 23/00 30/308.1 |
| 1,021,931 | A | | 4/1912 | James | |
| 1,034,256 | A | | 7/1912 | Landro | |
| 1,264,776 | A | | 4/1918 | Cox | |
| 1,280,465 | A | | 10/1918 | Herron | |
| 1,404,660 | A | | 1/1922 | Shugart | |
| 1,587,767 | A | | 6/1926 | Hobbs | |
| D155,287 | S | | 9/1949 | Hewes | |
| D157,123 | S | | 2/1950 | Boeye | |
| 2,804,109 | A | | 8/1957 | Fatica | |
| 3,245,094 | A | | 4/1966 | Shandel | |
| 3,352,335 | A | | 11/1967 | Koski | |
| D248,360 | S | | 7/1978 | Graves | |
| 4,139,930 | A | * | 2/1979 | Cox | B25D 1/00 30/308.1 |
| 4,175,601 | A | | 11/1979 | Meyer | |
| 4,181,166 | A | | 1/1980 | Jones | |
| D264,798 | S | | 6/1982 | Jones | |
| 4,381,809 | A | | 5/1983 | Kenjorski | |
| 4,558,726 | A | * | 12/1985 | Clay | B25D 1/00 81/20 |
| 4,682,417 | A | | 7/1987 | Henslin | |
| D299,412 | S | | 1/1989 | Zabarte | |
| D300,001 | S | | 2/1989 | Oberg | |
| D301,679 | S | | 6/1989 | Kokkinos | |
| D303,068 | S | | 8/1989 | Zabarte | |
| 5,009,010 | A | * | 4/1991 | Burlison | B26B 23/00 30/308.1 |
| 5,211,085 | A | * | 5/1993 | Liou | B25G 3/36 81/20 |
| D341,070 | S | | 11/1993 | Warren | |
| 5,297,306 | A | | 3/1994 | Shandel | |
| 5,709,031 | A | | 1/1998 | Van Beek | |
| 5,768,956 | A | | 6/1998 | Coonrad | |
| D442,048 | S | * | 5/2001 | Coonrad | D8/75 |
| 6,460,430 | B2 | * | 10/2002 | Coonrad | B25D 1/00 81/20 |
| 6,494,119 | B1 | * | 12/2002 | Coonrad | B25D 1/00 81/20 |
| 6,516,687 | B1 | | 2/2003 | Hile et al. | |
| 6,644,639 | B1 | | 11/2003 | Newton | |
| 6,901,822 | B2 | * | 6/2005 | Boys | B25D 1/045 30/308.1 |
| 7,181,994 | B2 | * | 2/2007 | Norton | B25D 1/00 81/20 |
| D551,529 | S | * | 9/2007 | Youngren | D8/75 |
| D572,993 | S | | 7/2008 | Baty et al. | |
| 7,472,484 | B2 | | 1/2009 | Smilanich | |
| 8,424,212 | B2 | * | 4/2013 | Clarke | B26B 23/00 30/308.1 |
| D690,181 | S | * | 9/2013 | Sykes | D8/76 |
| 2003/0110643 | A1 | | 6/2003 | Wickline | |
| 2006/0009144 | A1 | | 1/2006 | Frieswick et al. | |
| 2007/0227050 | A1 | | 10/2007 | Brown et al. | |
| 2008/0303199 | A1 | | 12/2008 | DiNatale | |

FOREIGN PATENT DOCUMENTS

| | | |
|---|---|---|
| EP | W09716289 | 5/1997 |
| FR | 597743 | 11/1925 |
| FR | 2541173 | 2/1983 |
| SE | 9500896 | 10/1996 |

* cited by examiner

APPARATUS FOR SPLITTING WOOD INTO KINDLING

CROSS-REFERENCE TO RELATED APPLICATION

This application is a continuation-in-part of, and claims the benefit of priority of, U.S. patent application Ser. No. 12/507,021, filed on Jul. 21, 2009 which is hereby incorporated by reference in its entirety.

TECHNICAL FIELD

Embodiments of the present invention relate to manual tools for splitting or chopping wood.

BACKGROUND

Hand tools used to cut wood through the ages often have taken the form of an axe, an adz, or a splitting wedge used with a blunt sledge hammer. Each type of tool has features that are useful for different purposes, but each tool also has certain limitations. For example, an axe or hatchet has a metal blade in line with the handle, a useful configuration for efficiently exerting a downward force to split relatively small logs with a single blow. However, if the single blow is not energetic enough to split the wood, the axe may become stuck in the wood. Dislodging an axe stuck in a piece of wood is an awkward, unpredictable, and risky activity. Larger logs benefit from the use of splitting wedges in which a wedge having a sharp blade is separate from a blunt sledge hammer used to safely drive the wedge into the wood with multiple blows. If the wedge gets stuck, a second or even a third wedge may be driven into the same piece of wood to multiply the splitting force. Drawbacks of such a "sledge and wedge" system include the weight of the sledge hammer and suitability for larger pieces of wood as opposed to kindling. An adz is another conventional cutting tool that uses a chisel or gouge-shaped blade for hewing and shaping timber. The adz features an axe blade oriented perpendicular to the handle, similar to a garden hoe, instead of in line with the handle, like a standard axe. Most existing wood-splitting tools are variations of these three well known forms, featuring a variety of different cutting head shapes, handle forms, and methods of attaching the blade to the handle.

SUMMARY

A novel splitting tool and a specialized chopping block described herein cooperate to enable kindling to be cut from ordinary firewood in an efficient and safe manner with a minimal application of force. The splitting tool applies leverage in addition to downward momentum of the cutting head to split wood. Extra leverage becomes possible with the use of a metal handle integrated with a metal cutting head, the cutting head and handle being formed or attached in a perpendicular configuration similar to an adz. However, the splitting tool differs from a conventional axe or adz in a number of respects. In addition to the all-metal construction, a widening profile of the handle near the cutting head has a unique triangular shape, thereby increasing the amount of leverage that may be applied to the wood. A secondary cutting blade is integrated into the end of the handle near the cutting head to split wood away from the face of the cutting head, thereby preventing the tool from getting stuck in the wood. In addition, the integrated flat top surfaces of the cutting head and the handle near the joint allow the user to drive the cutting head completely into the wood as though the cutting head were splitting wood.

The splitting tool is complemented by a specialized chopping block for holding wood in a steady, upright position. The chopping block features a V-shaped recess that is open on one end, allowing the user to slide a kindling log into the recessed platform until it is sufficiently braced, thereby accommodating kindling logs of various diameters.

The chopping block also provides resistance to the downward force of the splitting tool during the splitting action.

It is understood that this summary is provided as a means for generally determining what follows in the drawings and detailed description, and is not intended to limit the scope of the invention. The foregoing and other objects, features and advantages of the invention will be readily understood upon consideration of the following detailed description taken in conjunction with the accompanying drawings.

DETAILED DESCRIPTION OF EMBODIMENTS OF THE INVENTION

Figure 1:
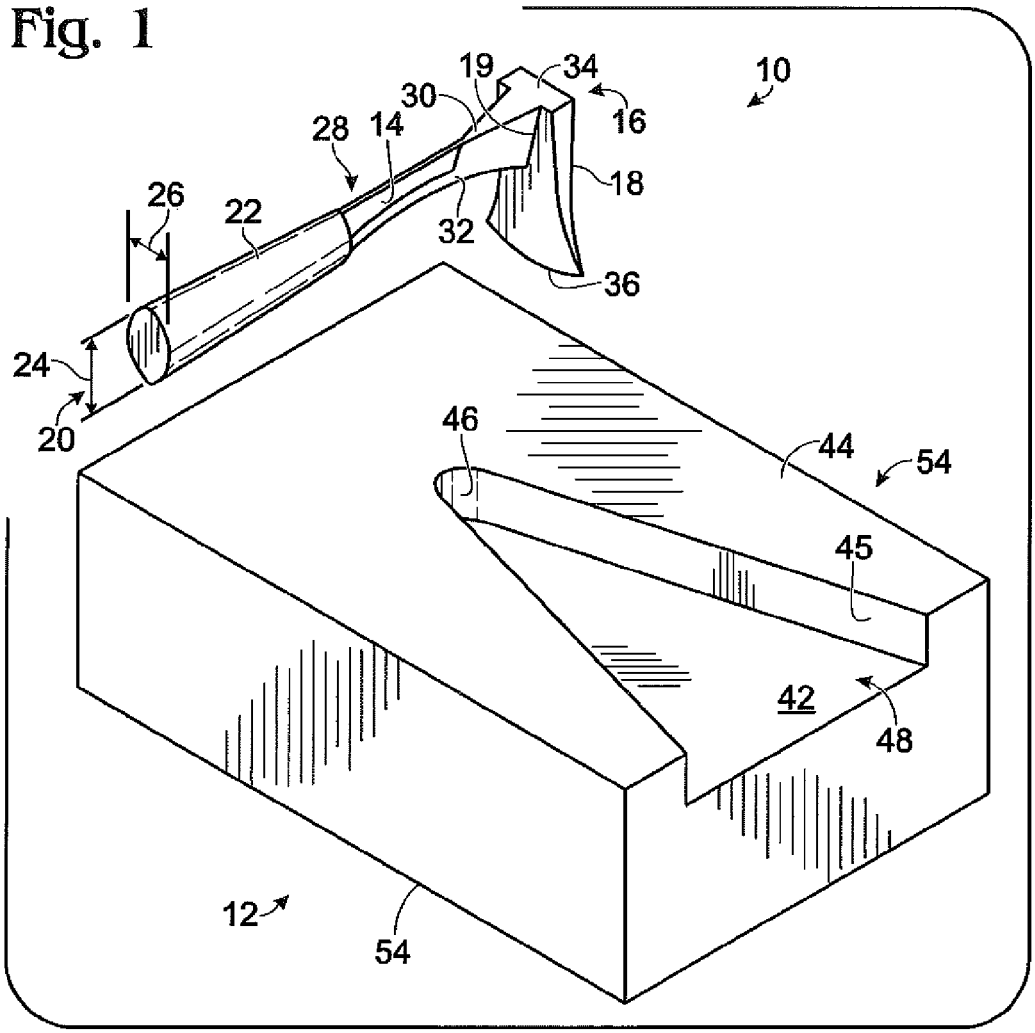
FIG. 1 is a perspective view of a first embodiment of a splitting tool and chopping block system, in accordance with a preferred embodiment.

FIG. 1 shows a perspective view of the two components described herein: a first embodiment of a splitting tool 10, and a chopping block 12, shown in approximate proportion to each other. The splitting tool 10 comprises a handle shaft 14, and, attached perpendicularly to a distal end 16 of the handle shaft 14, a tapered cutting head 18. Both handle shaft 14 and cutting head 18 are preferably made of steel and are preferably forged or cast into one continuous steel piece to maximize strength at a joint 19, though joint 19 generally may be formed by welding, soldering, or another method of attachment. At a proximal end 20 of handle shaft 14, opposite cutting head 18, steel handle shaft 14 is preferably partially surrounded by a rubber grip 22, covering about half the length of handle shaft 14, the rubber grip 22 providing both user comfort and impact resistance. Proximal end 20 of handle shaft 14 has an oblong profile that tapers along its length toward a mid-section 28 at which the rubber grip 22 ends.

Beyond mid-section 28, toward distal end 16, the cross section of handle shaft 14 widens near joint 19 to a shape that surrounds a broad, flat, upper handle shaft striking surface 30 and a tapered secondary cutting blade 32 on the underside of handle shaft 14 to assist the cutting head 18 in splitting wood. Secondary cutting blade 32 structurally reinforces joint 19 to better withstand the forces generated when prying wood apart. The butt, or upper surface, of cutting head 18 is also formed into a flat plane, providing a clean striking surface 34 opposite a primary cutting blade 36. In a preferred embodiment, striking surfaces 30 and 34 form a single, integrated flat plane. If primary cutting blade 36 should become lodged in the wood (because of the presence of knots, for example), removing cutting head 18 is made easier by the availability of the striking surfaces 30 and 34. By striking these flat surfaces with a mallet or other weighty object, an additional downward force is supplied to either finish splitting the wood by prying it apart, or to free cutting head 18 for another attempt.

FIG. 1 also shows a perspective view of the solid wood rectangular chopping block 12, having as its principal feature a V-shaped recessed platform 42, cut from its top surface 44. According to a preferred embodiment, recessed platform 42 has straight recessed walls 45 and a rounded point 46 opposite an open end 48. For example, a kindling log may be slid through open end 48, and wedged into rounded point 46 in an upright position for processing.

Figure 2:
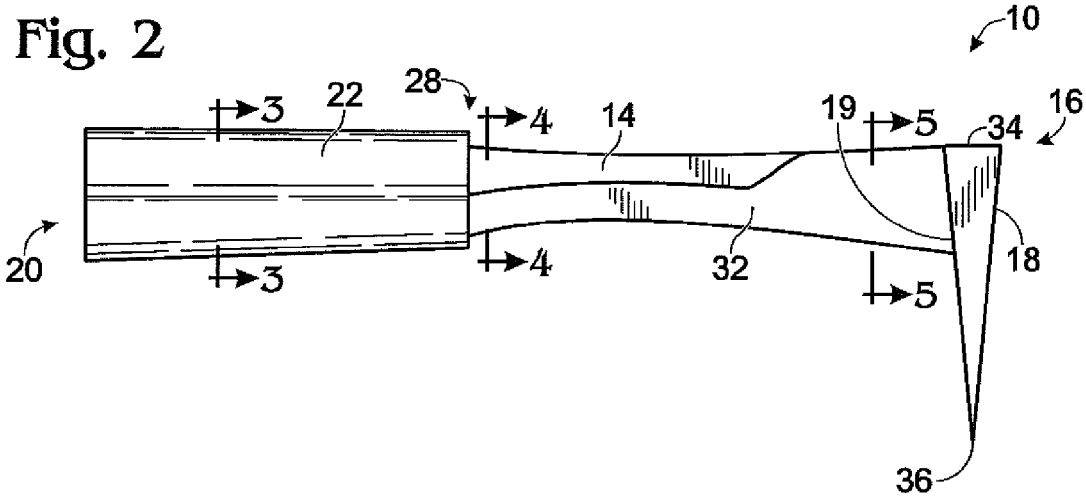
FIG. 2 is a side view of the first embodiment of the splitting tool showing the cutting head, handle, and joints as well as cut lines corresponding to cross sectional views shown in FIGS. 3-5.

FIG. 2 shows a side view of splitting tool 10 having three sets of cut lines to demonstrate variations in the cross-sectional profile along the length of handle shaft 14. According to a preferred embodiment, approximate dimensions of handle shaft 14 include a circumference of about 3 inches, and a total length of about 10 inches, of which a sharp edge on secondary cutting blade 32 extends about three inches from joint 19 toward proximal end 20.

Figure 3:
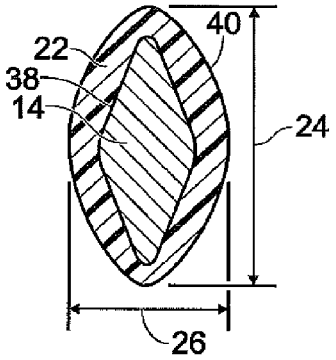
FIG. 3 is a cross-sectional view of the steel handle shaft and rubber grip of the first embodiment of the splitting tool along a cut line 3-3, shown in FIG. 2.
Figure 4:
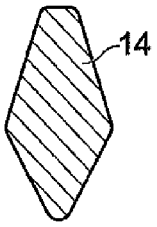
FIG. 4 is a cross-sectional view of the steel handle shaft of the first embodiment of the splitting tool along a cut line 4-4, shown in FIG. 2.
Figure 5:
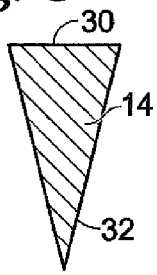
FIG. 5 is a cross-sectional view of the steel handle shaft near the cutting head, of the first embodiment of the splitting tool along a cut line 5-5, shown in FIG. 2.

FIGS. 3-5 show specific cross-sectional profiles along cut lines 3-3, 4-4, and 5-5, respectively, shown in FIG. 2. FIGS. 3 and 4 show that the oblong profile at proximal end 20 is preferably oriented so that its vertical dimension 24 exceeds its horizontal dimension 26, and that steel handle shaft 14 has a profile in a rounded diamond shape 38. FIG. 3 additionally shows that the rubber grip 22 surrounding the proximal end 20 of handle shaft 14 causes the overall form of the handle to have an oval shape 40. At mid-section 28 of the steel handle shaft 14, beyond the end of rubber grip 22, the profile simply comprises the core rounded diamond shape 38. The cross-sectional profile of steel handle shaft 14 near distal end 16 tapers to a point at the bottom, and the flat top gradually widens toward joint 19, forming an elongated triangular shape shown in FIG. 5.

Figure 6:
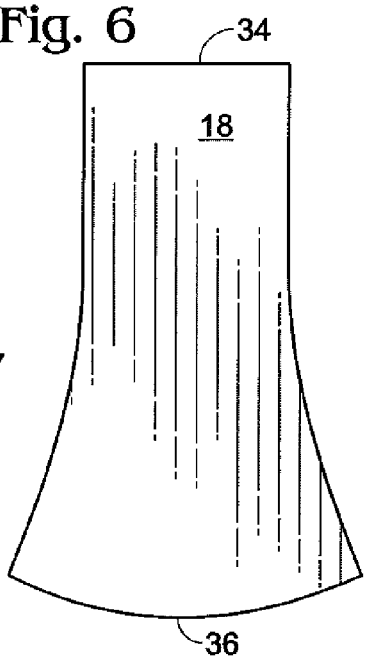
FIG. 6 is a front view of the cutting head of the first embodiment of the splitting tool.

FIG. 6 is an end view of the four-sided cutting head 18 showing the primary cutting blade 36, the convex curve of the blade profile having a radius of curvature of about 3 inches. According to a preferred embodiment, cutting head striking surface 34, opposite primary cutting blade 36 is about 1.75 inches wide and 0.75 inches deep, providing ample surface area for use as a striking surface in conjunction with surface 30 on handle shaft 14. Cutting head 18 is preferably about 4.75 inches long. The sides of cutting head 18 are contoured in a concave curve having about a 5 inch radius of curvature. As cutting head 18 is driven into the wood, secondary cutting blade 32 on the bottom of the handle opens a second split at a right angle to the main split initiated by primary cutting blade 36 on cutting head 18. This action exerts transverse shear forces on the wood to enhance the splitting. The mechanical advantage of the secondary cutting blade 32 used as a lever, in cooperation with primary cutting blade 36, splits apart even hard, dense wood with relatively little effort.

Figure 7:
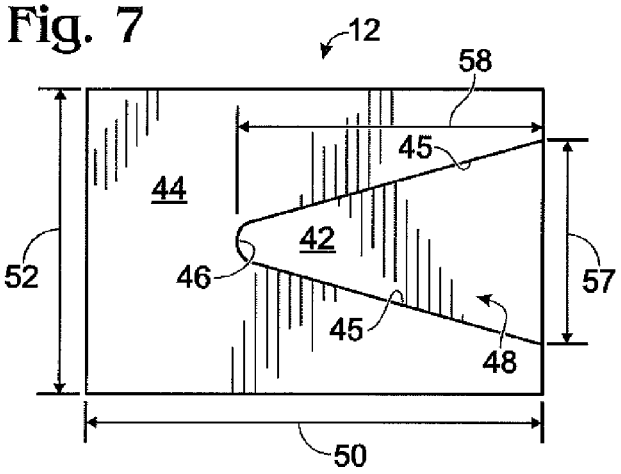
FIG. 7 is a top view of the chopping block shown in FIG. 1 in accordance with a preferred embodiment.
Figure 8:
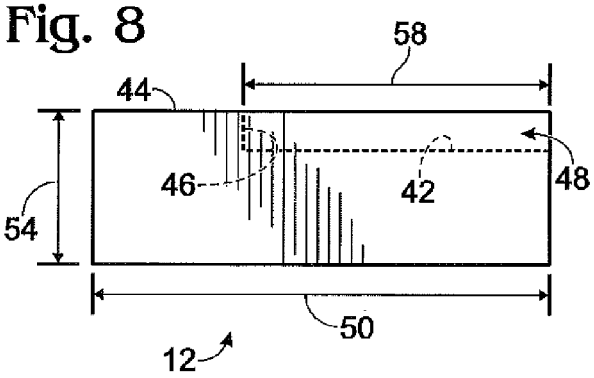
FIG. 8 is a front view of the chopping block shown in FIG. 1.
Figure 9:
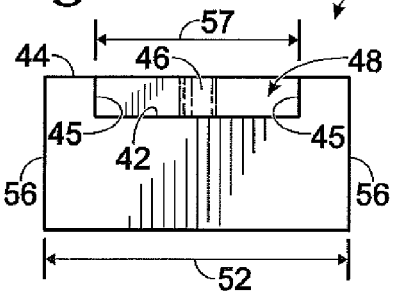
FIG. 9 is a cross-sectional view of the chopping block shown in FIG. 1.

FIGS. 7-9 pertain to chopping block 12, a specialized embodiment that complements splitting tool 10, to complete a wood chopping system for kindling. FIG. 7 provides a top view of the solid wood rectangular chopping block 12, preferably having approximate outer dimensions including a length 50 of 1.5 ft, a width 52 of 1.0 ft, and a thickness 54 of 6 inches. According to a preferred embodiment, V-shaped recessed platform 42 is cut from one end of chopping block 12 and positioned symmetrically with respect to the width 52 of chopping block 12. V-shaped recessed platform 42 preferably has straight sides 56 measuring about 12 inches, and is cut to a depth of about 1.5 inches. Open end 48 preferably has a width 57 of about 8 inches, leaving 2 inches of the solid chopping block 12 raised about the recessed platform 42 on either side. Likewise, the projection 58 of each of sides 56 along the length 50 of the chopping block 12 is preferably also about 8 inches. Recessed platform 42 provides a secure base to hold a subject piece of wood steady for splitting by splitting tool 10, and a means of resisting the additional leverage imparted to the wood through the use of tapered secondary cutting blade 32.

FIGS. 10-14 show a second embodiment of a splitting tool. Referring primarily, but not exclusively, to FIG. 10, splitting tool 100 has a cutting head 102, a handle 104 and a handle extension 106. The cutting head has a first cutting edge 108, and the handle 104 and handle extension 106 are substantially perpendicular to the first cutting edge. The bottom of the handle has a second cutting edge 110 that is also perpendicular to the first cutting edge 108.

In addition to the first cutting edge, the cutting head comprises a top portion 112, having a front face 114 and a back face 116 that are preferably essentially parallel to one another. "Essentially" is used herein to mean that, while not necessarily precisely parallel, the top portion would be understood to be of uniform thickness from front to back as a practical matter. However, it is to be understood that, while the use of a top portion having uniform thickness is desirable for cutting head strength, a non-uniform thickness may be used without departing from the principles of the invention. The cutting head also comprises a middle portion 118, having a front surface 120 and a back surface 122 that taper from the front surface 114 and back surface 116 of the top portion toward the first cutting edge 108. The cutting edge is formed to be sharp, as for example by grinding the bottom edge of the cutting head.

Figure 11:
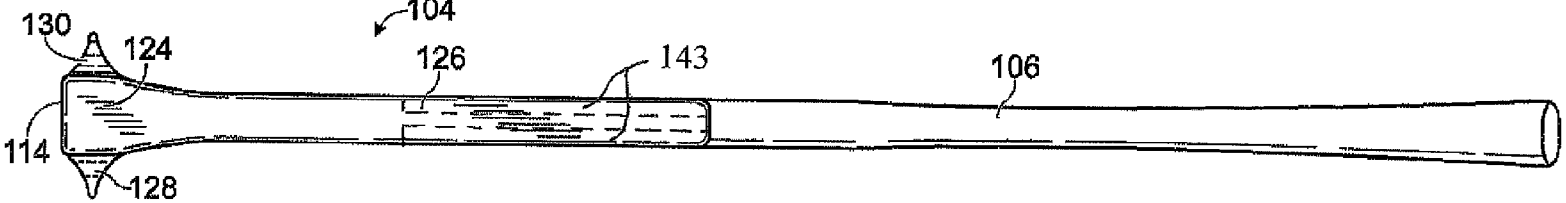
FIG. 11 is a top view of the second embodiment of the splitting tool shown in FIG. 10.
Figure 12:
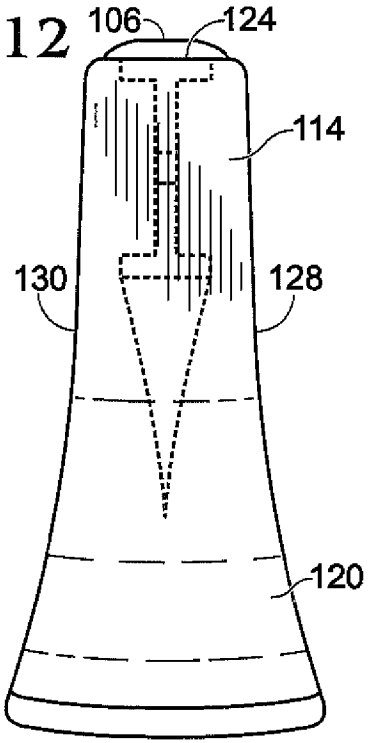
FIG. 12 is a front view of the second embodiment of the splitting tool shown in FIG. 10.

Referring to FIGS. 11 and 12 in particular, the cutting head preferably has a flat portion 124 opposite the first cutting blade 108. This facilitates the application of impulses of force to the cutting head when it is wedged into a piece of wood, for example by striking it with a piece of kindling. To this end, it is preferred that the flat portion 124 of the cutting head actually extends along the top 126 of the handle 104. The cutting head further comprises a first side 128 and a second side 130, which taper outwardly from the top of the cutting head to the first cutting edge 108 at the bottom of the cutting head.

Figure 10:
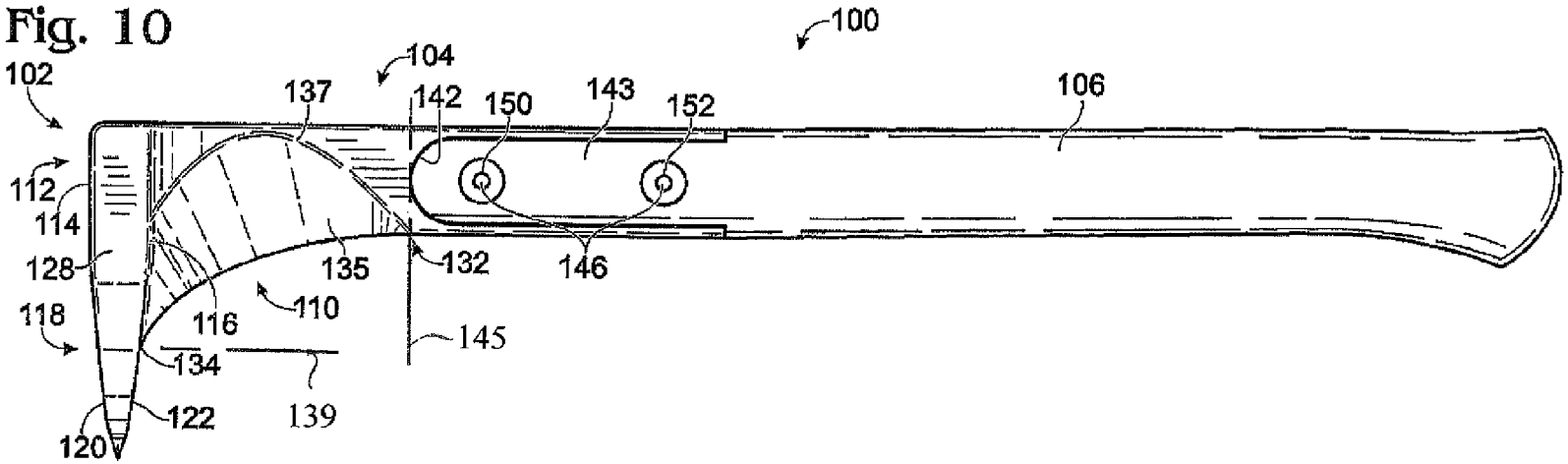
FIG. 10 is a side view of a second embodiment of the splitting tool showing a cutting head including a handle, and a handle extension attached to the cutting head.
Figure 13:
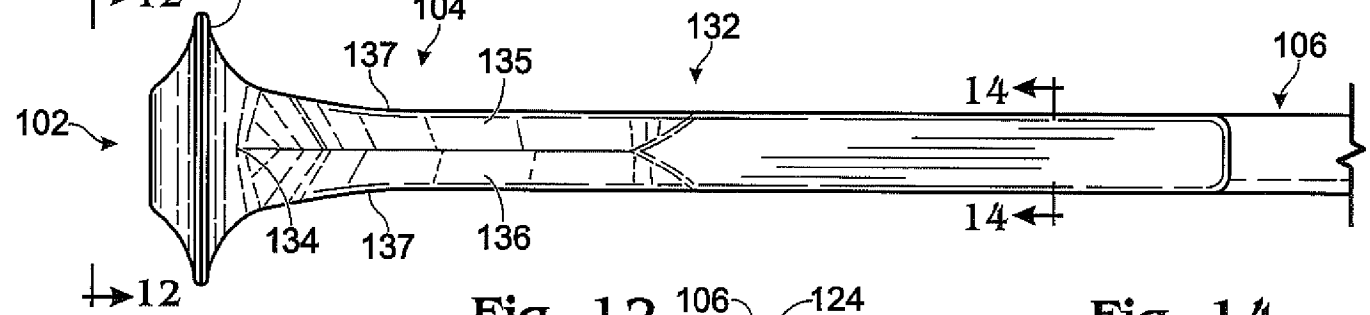
FIG. 13 is a bottom view of the second embodiment of the splitting tool shown in FIG. 10.
Figure 14:
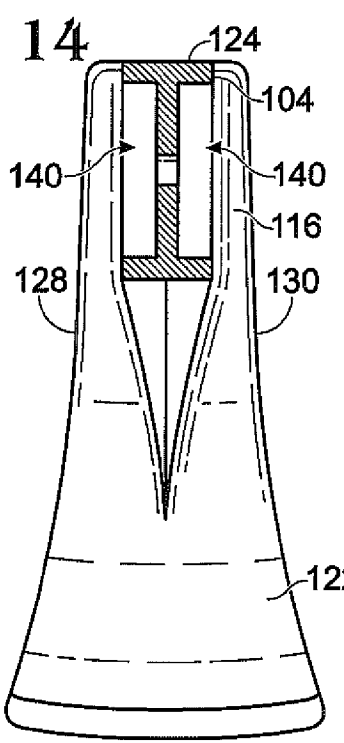
FIG. 14 is an end view of the cutting head with the handle extension removed.

Turning to FIG. 10 and FIG. 13 in particular, the second cutting blade, which is disposed on the bottom of the handle 104 starts at the bottom of the handle spaced at a location 132 away from the cutting head and extends arcuately toward the cutting head terminating at a location 134 lower than the bottom of the handle, as shown by line 139. The two side surfaces 135, 136 taper away from the second cutting edge and from one another to form arcuate surface transitions 137 in both sides of the handle.

It has been found that, while it is preferable for strength that the cutting head and handle be made of metal, such as steel, it is also preferable that the handle extension 106 be made of wood, such as steel, it is also preferable that the handle extension 106 be made of wood, or material having strength and resiliency characteristics similar to wood. In this second embodiment, the handle includes recesses 140 on both sides thereof, as shown by FIG. 15, which produces a "I" shaped cross section at the rear portion of the handle. Preferably, the recesses terminate adjacent the beginning of the second cutting blade with semi-circular ends 142 at a location identified by line 145. The handle extension is then attached by a slotted end 143 that fit into the recesses and are held in place by threaded fasteners 146 passing through apertures 150 and 152, respectively, in the handle and handle extension.

Although certain embodiments have been illustrated and described herein, it will be appreciated by those of ordinary skill in the art that a wide variety of alternative or equivalent embodiments or implementations calculated to achieve the same purposes may be substituted for the embodiments illustrated and described without departing from the scope of the present invention. Those with skill in the art will readily appreciate that embodiments in accordance with the present invention may be implemented in a very wide variety of ways. This application is intended to cover any adaptations or variations of the embodiments discussed herein.

The terms and expressions which have been employed in the foregoing specification are used therein as terms of description and not of limitation, and there is no intention, in the use of such terms and expressions, to exclude equivalents of the features shown and described or portions thereof, it being recognized that the scope of the invention is defined and limited only the claims that follow.

The invention claimed is:

1. A tool for splitting wood, comprising:

a cutting head having opposed top and bottom ends, the bottom end terminating in a first cutting edge; and a handle having top and bottom sides corresponding to the top and bottom ends, respectively, of the cutting head, a longitudinal axis that is substantially perpendicular to the first cutting edge, and a portion that is joined to the cutting head, extends away from the cutting head and defines two side surfaces that converge to form a second cutting edge on the bottom side of the handle, wherein the two side surfaces taper away from the second cutting edge and from one another to form an arcuate surface transition in the handle.

2. The tool of claim 1, wherein the cutting head includes a top portion opposite the first cutting edge having two essentially parallel surfaces that are substantially perpendicular to the handle and a middle portion having two non-parallel surfaces that taper from the essentially parallel surfaces toward one another to define the first cutting edge.

3. The tool of claim 2, wherein the cutting head includes a substantially flat portion opposite the first cutting edge, and two opposing side surfaces that taper outwardly from the substantially flat portion to the first cutting edge, so that the first cutting edge is wider, in a direction that is perpendicular to the handle, than the substantially flat portion.

4. The tool of claim 2 wherein the handle has an end opposite the cutting head, the tool further comprising two handle recesses formed in the handle on opposite sides of the handle and extending from the end of the handle opposite the cutting head toward the cutting head to receive a handle extension.

5. The tool of claim 4, further comprising a handle extension having a slotted end that engages the two handle recesses so as to allow for attaching the handle extension to the handle.

6. The tool of claim 5, wherein the handle and the slotted end of the handle extension has lateral apertures formed there through that are positioned to align when the handle extension is positioned with respect to the handle for receiving fasteners to fasten the handle extension to the handle.

7. The tool of claim 6, further comprising threaded fasteners disposed in the lateral apertures to fasten the handle extension to the handle.

8. The tool of claim 7, wherein the handle extension is made of wood.

9. The tool of claim 4 wherein a lateral cross section of the handle including the recesses is "I" shaped.

10. The tool of claim 4, wherein the recesses terminate longitudinally of the handle at a termination location spaced away from the cutting head.

11. The tool of claim 10, wherein the recesses terminate with respective substantially semi-circular edges.

12. The tool of claim 10, wherein the second cutting edge starts at the bottom side of the handle at location of the handle extension which is substantially no further away from the cutting head than the location where the recesses terminate, and extends toward the cutting head.

13. The tool of claim 12, wherein the second cutting edge terminates at a location lower than the bottom of the handle.

14. The tool of claim 10, wherein the arcuate surface transition in the handle begins adjacent the location where the recesses terminate and ends adjacent the cutting head.

15. The tool of claim 14, wherein the cutting head includes a substantially flat portion opposite the first cutting edge.

16. The tool of claim 15, wherein the cutting head includes two opposing side surfaces that taper outwardly from the substantially flat portion to the first cutting edge, so that the first cutting edge is wider, in a direction that is perpendicular to the handle, than the substantially flat portion.

* * * * *